US007044720B1

(12) United States Patent
Yamamoto et al.

(10) Patent No.: US 7,044,720 B1
(45) Date of Patent: May 16, 2006

(54) FAN MOTOR

(75) Inventors: Katsuhiko Yamamoto, Niigata-ken (JP); Hiroshi Aoki, Niigata-ken (JP)

(73) Assignee: Toshiba Home Technology Corporation, (JP)

( * ) Notice: Subject to any disclaimer, the term of this patent is extended or adjusted under 35 U.S.C. 154(b) by 0 days.

(21) Appl. No.: 11/025,735

(22) Filed: Dec. 29, 2004

(30) Foreign Application Priority Data

Dec. 10, 2004 (JP) ..... 2004-357564

(51) Int. Cl.
*F04B 17/03* (2006.01)
*F01D 3/02* (2006.01)
*B63H 1/26* (2006.01)

(52) U.S. Cl. ..... 417/423.1; 415/102; 416/223 B; 416/243

(58) Field of Classification Search ..... 417/423.1, 417/423.3; 415/175, 176, 177, 178, 102; 416/223 R, 223 B, 243
See application file for complete search history.

(56) References Cited

U.S. PATENT DOCUMENTS 3,536,417 A * 10/1970 Merkle et al. ..... 416/223 R
4,526,506 A * 7/1985 Koger et al. ..... 415/98
4,530,639 A * 7/1985 Mowill ..... 415/98
5,372,477 A * 12/1994 Cole ..... 415/218.1
5,979,541 A * 11/1999 Saito ..... 165/80.3
6,048,024 A * 4/2000 Wallman ..... 297/180.14
6,210,118 B1 * 4/2001 Egawa et al. ..... 416/243
6,348,748 B1 * 2/2002 Yamamoto ..... 310/62

FOREIGN PATENT DOCUMENTS

JP 2004-140061 5/2004

* cited by examiner

*Primary Examiner*—Charles G. Freay
(74) *Attorney, Agent, or Firm*—Akerman Senterfitt

(57) ABSTRACT

A fan motor with an increased amount of air drawn in toward fan blades so as to obtain a desirable airflow characteristic. A fan motor includes a rotor and a plurality of fan blades provided radially therefrom. Each fan blade is provided with an air intake part on a proximal side and a radial part on a distal side, including a first front surface on the former side and a second front surface on the latter side. The first and second front surfaces have different curvatures. Thus, air F can be impelled out toward a perimetric direction, and at the same time the intake of air toward the fan blades is promoted. Accordingly, the amount of air to be drawn in toward the fan blades is increased, thereby obtaining desirable airflow characteristic.

21 Claims, 3 Drawing Sheets

FAN MOTOR

BACKGROUND OF INVENTION

1. Field of the Invention

The present invention relates to a fan motor, mounted, for example, to a thin electronic appliance such as a notebook type personal computer, including fan blades extending radially from around a perimeter of a rotor.

2. Description of Related Prior Art

In recent years, increase in processing speed of electronic components (e.g. MPU) for processing various data such as letters, sounds and/or images as well as further multi-functionality thereof has been strived for. Those electronic appliances tend to emit more heat as the degree of circuit integration and the performance of electronic components enhance.

On the other hand, further small-sizing and thinning have been required in a field of thin electronic appliances such as notebook computers, and thus it has been a crucial issue how the heat from electronic components mounted on a printed board is effectively cooled within such a limited space as the inside of a thin electronic appliance. Thus, a cooling fan with fan blades provided radially from around a rotor is installed to the inside of a thin electronic appliance in order to control heat of electronic components such as MPU.

Conventional centrifugal fan motors, as disclosed in Japanese Un-Examined Patent Publication No. 2004-140061, comprises a casing serving as a base for installing a fan body thereto and a cover for covering an upper surface of a frame, thus defining an outer contour having an air sending passage formed thereinside. The casing includes a rotor with fan blades arranged radially with respect to a rotational axis thereof and a motor serving as a drive force for imparting rotary drive to the rotor, thus providing a fan assembly of a double-sided-air-intake type.

Referring to FIG. 6 showing a more specific structure of the conventional fan motor, the outer contour of a flat fan motor 1 is composed of a casing 2 and a cover 3, while a fan assembly 7 comprising: a cup-shaped rotor 4; a plurality of fan blades extending fan around a perimeter of the rotor 4; and a motor 6 for imparting rotary drive force to the rotor 4 is accommodated into the outer contour of the fan motor 1. Intake holes 8, 9 for sending air to the fan assembly 7 are provided in the casing 2 and the cover 8, respectively, said intake holes 8, 9 being located on opposite ends along a rotational axis 4A of the rotor 4. A discharge hole 10 for discharging air to the outside is provided in the direction orthogonal to the respective intake holes 8 and 9.

When the fan blades 5 are rotated together with the rotor 4 by energizing the motor 6, air F is drawn in from the two intake holes 8, 9 provided on top and bottom sides of the fan assembly 7. The air thus drawn in is fed out toward the rotation direction of the fan blades 5 so that it is discharged toward the outside of the thin electronic appliance from the discharge hole 10 provided on one side of the fan motor 1 through the fan motor 1.

Referring now to FIGS. 7(A) and 7(B) each showing a section of the conventional fan blade 5 of FIG. 6, FIG. 7(A) shows a section of an air intake part 21 where air F is drawn in, while FIG. 7(B) shows a section of a distal part 22 located more distantly from the rotational axis 4A in the center of the rotor 4 than the air intake part 21. Numerals 23A and 24A designate a front surface of the air intake part 21 facing toward the rotating direction of the fan blade 5 and a rear surface thereof, respectively, while numerals 28B and 24B designate a front surface of the distal part 22 facing toward the rotating direction of the fan blade 5 and a rear surface thereof, respectively.

FIG. 8 illustrates the airflow F at the rotor 4 side (i.e., the proximal side) of the fan blade 5, which is in other words at the air intake part 21 side, where the front surface 23A facing toward the rotating direction of the fan blade 5 has the same contour as the front surface 23B at the perimetric (i.e., distal) side of the fan blade 5, which is in other words at the distal part 22 side, and thus it is arranged perpendicularly to an intake face for introducing air F from the intake holes 8 and 9. It is to be noted that the above-mentioned configuration of the front surface 23A only functions to impel the air F drawn into the air intake part 21 toward the perimetric direction, and makes no contribution to the intake of air toward the fan blade 5, which has caused dissatisfaction to users.

SUMMARY OF THE INVENTION

To eliminate the above-mentioned problems, it is, therefore, an object of the present invention to provide a fan motor with an increased amount of air to be drawn in toward the fan blades to realize desirable airflow characteristic.

To attain the above object, there is proposed, from a first aspect of the invention a fan motor which comprises:

a rotor;

one or more fan blades extending in a radial direction of the rotor, each fan blade having a proximal side adjacent to the rotor and a distal side, wherein the fan blade has a first surface on the proximal side and a second surface on the distal side, said first and second surfaces having different curvatures.

With the fan blade surface arranged thus way, not only can the fan motor of the invention impel the air toward a perimetric direction, but also can facilitate the intake of air toward the fan blades. Accordingly, the amount of air to be drawn in toward the fan blades is increased, thereby enabling a desirable airflow characteristic to be obtained.

From a second aspect of the invention, there is proposed a fan motor having the elements of the first aspect, wherein the fan blade has a different fitting angle to the rotor on the proximal side than on the distal side. Thus, it is possible to direct the air impelled by the surfaces of the fan blades toward a desirable direction.

From a third aspect of the invention, there is proposed a fan motor which comprises:

a rotor;

one or more fan blades extending in a radial direction of the rotor, each fan blade having an air-intake proximal side and a distal side outward of the air-intake proximal side, the air-intake proximal side and the distal side defining an inner perimetric side and an outer perimetric side, respectively when the rotor is rotated, wherein the fan blade has a first surface on the air-intake proximal side and a second surface on the distal side, the first and second surfaces having different curvatures.

With the fan blade surface arranged thus way, not only can the fan motor of the invention impel the air toward the perimetric direction, but also can facilitate the intake of air specifically toward the intake portions of the fan blades.

Accordingly, the amount of air to be drawn in toward the fan blades is increased, thereby enabling a desirable airflow characteristic to be obtained.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which:

FIG. 6 is an entire section of a conventional centrifugal fan motor.

DETAILED DESCRIPTION OF THE INVENTION

Figure 1:
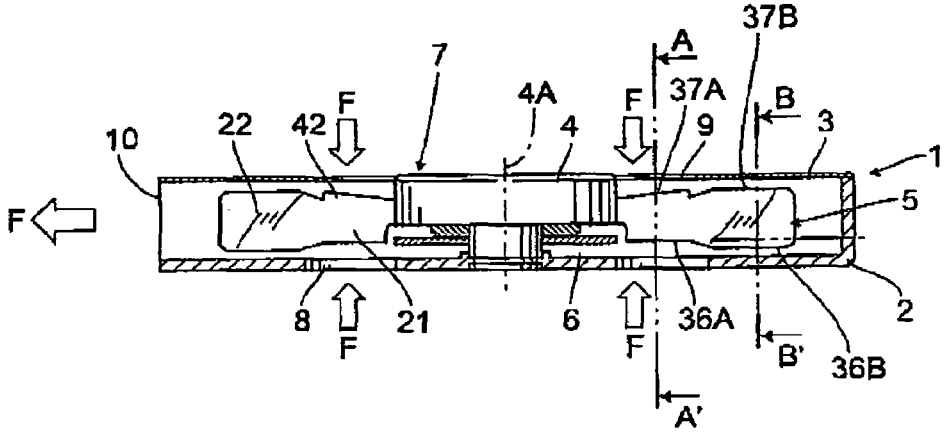
FIG. 1 is an entire section of a centrifugal fan motor in accordance with an embodiment of the invention.

Hereinafter are explained preferred embodiments of a fan motor of the invention with reference to the attached drawings. The same portions as those described in the foregoing prior art paragraph are designated by the same reference numerals, and their repeated detailed descriptions are omitted.

Figure 2:
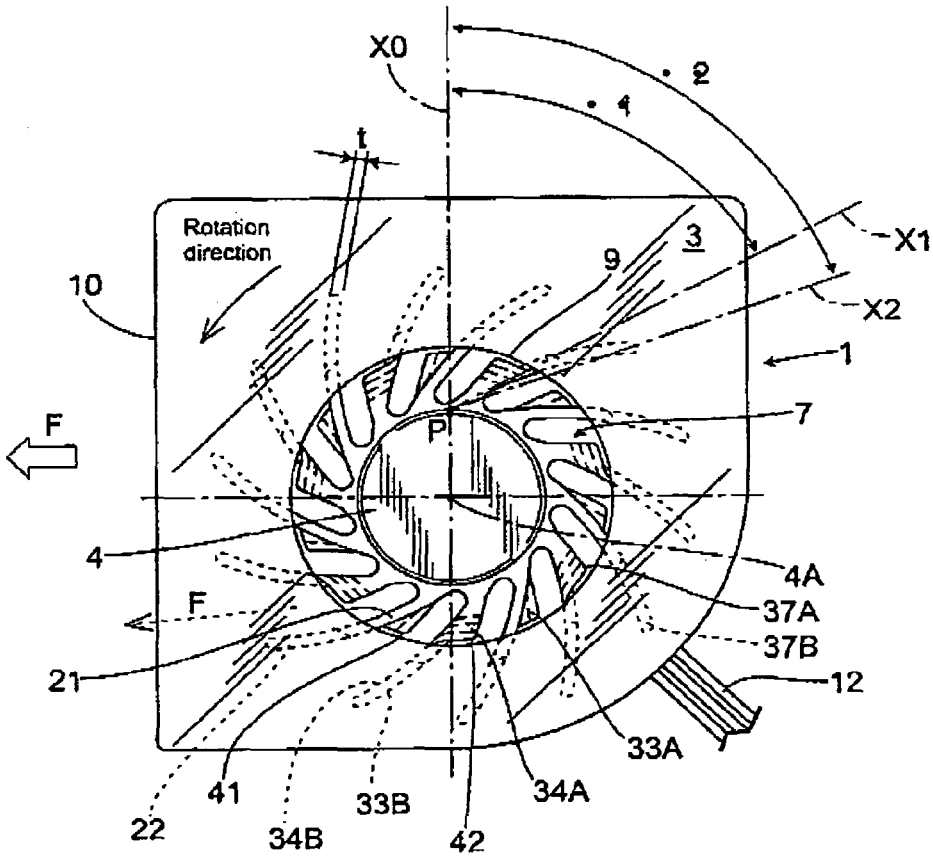
FIG. 2 is a plan view of the centrifugal fan motor in accordance with the embodiment of the invention.

In FIGS. 1 and 2 showing a first embodiment of the invention, reference numeral 1 designates a fan motor serving as an air sending device, having a flat outer contour as a whole, accommodated into a thin electronic appliance such as a notebook type personal computer. The fan motor 1 includes a fan assembly 7 serving as an air sending body thereinside. The outer contour of the fan motor 1 is composed of a casing 2 with a bottom made of a member having an excellent heat conductance, and a cover for covering a top opening of the casing 2.

As described above, the fan assembly 7 is composed of the rotor 4 serving as a cup-shaped rotation body, a plurality of the fan blades 5 extending radially from the perimeter of the rotor 4 and the motor 6 for rotating the rotor 4 and the fan blades 5 around the rotational axis 4A due to the electromagnetic action with a magnet (not shown) mounted to the inner peripheral surface of the rotor 4. Reference numeral 12 is a lead wire for electrically connecting with the motor 6. The intake holes 8, 9 for sending air to the fan assembly 7 are provided opposite to each other, one being provided in the casing 2 at one side in the direction of the rotation axis 4A of the rotor 4 while the other being provided in the cover 3 at the opposite side thereof. The discharge hole 10 for discharging air to the outside of the fan motor 1 is provided in a certain direction perpendicular to the direction defined by the intake holes 8, 9.

The number of the fan blades is not limited to a specific number as long as it is two or more. The discharge hole 10 of the fan motor 1 is not necessarily provided in a single direction only, but may be provided in the perimetric direction of the fan assembly 7 so as to be provided along the entire perimeter thereof. Each fan blade 5 may be attached to the perimeter of the rotor 4, but it is preferable from a standpoint of productivity that each fan blade 5 and the rotor 4 are integrally formed from a single piece member.

The present embodiment features the specific configuration of the fan blade 5 that contributes to the intake of air toward the fan assembly 7. Accordingly, the configuration of the fan blade 5 will now be described in more detail with reference to FIGS. 3 and 4.

The fan blade 5 comprises an air intake part 21 located on the proximal or rotor 4 side, opposite to the intake holes 8 and 9, said air intake part 21 being a part toward which air F is drawn in from the intake holes 8 and 9; and a distal part 22 located outside the air intake part 21, said distal part 22 being surrounded by the casing 2 and the cover 3, wherein the air intake part 21 of the fan blade 5 includes a front surface 33A facing toward the rotating direction of the fan blade 5 and a rear surface 34A thereof said front surface 33A and rear surface 34A extending non-flatly, but being curved relative to the direction defined by the intake holes 8 and 9, as is shown in FIG. 3(A). On the other hand, the distal part 22 of the fan blade 5 includes a front surface 33B facing toward the rotating direction of the fan blade 5 and a rear surface 34B thereof, said front surface 34A and rear surface 34B extending flatly, without any concave or convex curves, so that they are arranged vertically relative to air-intake surfaces for drawing in the air F from the intake holes 8 and 9, as shown in FIG. 3(B). In other words, for the configurations of the respective front surfaces 33A and 33B, the front surface 33A of the air intake part 21 has a first curvature (not zero) while the front surface 33B of the distal part 22 has a second curvature (zero) that is different from the first curvature. Particularly, due to the front surface 33A of the air intake part 21 being shaped into a curved surface, the air F from the intake holes 8 and 9 can be impelled in a manner like being raked up toward the front side of the fan blade 5.

Figure 3:
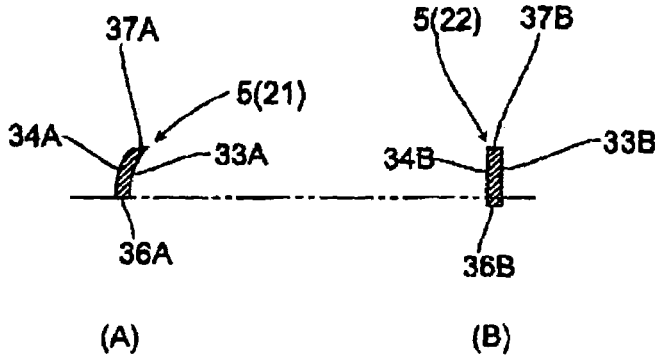
FIG. 3 (A) is a section of the fan motor of FIG. 1 taken along A–A' line thereof, while FIG. 3 (B) is a section thereof taken along B–B' line thereof.
Figure 4:
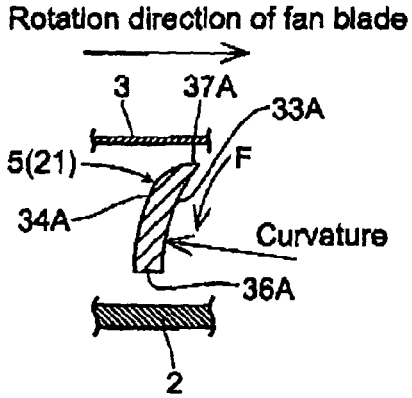
FIG. 4 is a section of a principal part of a fan blade, illustrating airflow in the fan motor in accordance with the embodiment.

The curvature of the front surface 33A on the air intake part 21 side does not need to be uniform over the whole part there. For example, whilst the front surface 33A shown in FIG. 3 (A) is formed into a shape of an arc surface whose curvature is approximately uniform over a whole part thereof, the front surface 33A may be formed such that it first extends in the form of an arc surface having a constant curvature from a first end face 37A opposite to the intake hole 9 (or from a second end face 36A opposite to the intake hole 8) to a point partway to the second end face 36A (or the first end face 37A) and then it extends in the form of an approximately flat plane having a curvature of nearly zero as it approaches the second end face 36A (or the first end face 37A). By farming the front surface 33A of the fan blade 5 so that the front surface 33A may have a shape with such combined different curvatures, an initial strong impelling force by the fan blade 5 is allowed to act on the air F advancing from the first end face 37A toward the second end face 36A, thus enabling the intake of air to be facilitated extremely effectively. Meanwhile, whilst the center of the curvature radius of the front surface 33A illustrated in FIGS. 3 and 4 is situated below the front surface 33A, it may be situated thereabove.

As shown in FIG. 2, the fan blade of the present embodiment is provided with either a first tongue 41 which is located in the air intake part 21 and extends forward from the second end face 36A opposite to the intake hole 8 or a second tongue 42 which extends forward from the first end face 37A opposite to the other intake hole 9, said first and second tongues 41 42 being alternately provided.

In other words, there are two different types of the fan blades 5 provided in this embodiment, and thus the air F from the intake hole 8 is raked by the first tongue 41 and the air F from the other intake hole 9 is raked by the second tongue 42 by rotating the respective fan blades 5. Moreover, thickness t of the fan blade 5 may be preferably 1.5 mm or below in order to reduce as much resistance of air drawn in from the intake holes 8 and 9 as possible. Alternatively, all the fan blades 5 may have different configurations, individually. In the case that the intake hole is provided at one side only, such as a case in which the intake hole 9 is on the one side while the intake hole 8 is not on the other side, then the fan blades 5 each having the same shape, provided with the second tongue 42 may be arranged in the whole perimeter of the rotor 4. Although the air intake part 21 of each fan blade 5 adjacent to the rotor 4 is disposed inwardly of the casing 2 and the cover 3 in the present embodiment, the air intake part 21 of the fan blade 5 may be protruded outwardly of the casing 2 and the cover 3 in order to further increase the air-introducing-force. In that case, a part of the sir intake part 21 of the fan blade 5 is allowed to pass through the air intake holes 8 and/or 9 without contacting the same.

Referring again to FIG. 2, a proximal end of a joint portion between the rotor 4 and one of the fan blades 5 is denoted by symbol P located in a perimeter of the cylindrical rotor 4, while a normal line to the perimeter of the rotor 4 that passes through this proximal end P is denoted by symbol X0. Also, a line extending from the proximal end P to the outer end of the air intake part 21 of the fan blade 5 is denoted by symbol X1, while a line extending from the proximal end P to the outer end of the distal part 22 of the fan blade 5 is denoted by symbol X2. It is to be noted that an angle theta 1 of the line X1 to the normal line X0 is smaller than an angle theta 2 of the line X2 to the normal line X0. In other words, it is to be noted that a fitting angle of the air intake part 21 of the fan blade to the rotor 4 (i.e., 90 deg minus theta 1) is greater than a fitting angle of the distal part 22 of the fin blade 5 to the rotor 4 (i.e., 90 deg minus theta 2), and that the fan blade 5 does not extend in a straight line but in a curved line curving from the proximal point P in an arch-like manner toward the rotating direction. More preferably, the fan blade 5 may be configurated so that the contour thereof goes along the direction of a resultant force of a rotating force and a centrifugal force to which the air F drawn in to the fan assembly 7 is subjected to, thereby enabling the air F to be efficiently sent out toward the distal end of the fan blade 5 with the least possible resistance.

Next is a description of the action of the above-structured fan motor. When the motor 6 is energized through a lead wire 12 and thus a magnet attached to an inner periphery of the rotor 4 is given a rotary drive force, the fan blades 5 integrally formed with the rotor 4 are rotated together. At this moment, the air F inhaled from the end face 37A toward the fan blade 5 through the intake hole 9 is allowed to flow in a manner like being raked up, in the vicinity of the air intake part 21 that is adjacent to the rotor 4 and opposite to the intake hole 9, specifically owing to the front surface 33A having a preset curvature, being provided with the second tongue 42 on the end face 37A. In that case, the air flows downward toward the opposite end surface 36A, as illustrated in FIG. 4. Likewise, the air F inhaled from the other end face 36A toward the fan blade 5 through the other intake hole 8 is allowed to flow in a manner like being raked up, in the vicinity of the air intake part 21 that is adjacent to the rotor 4 and opposite to the intake hole 8, specifically owing to the front surface 33A having a preset curvature, being provided with the first tongue 41 on the end face 36A. In that case, the air flows upward toward the opposite end surface 37A. Impelling the air F by the front surface 33A of each fan blade 5 thus way makes remarkable contribution to an increase in amount of air to be inhaled from each of the intake holes 8, 9 toward the fan blade 5.

The air impelled by the front surface 33A of each fan blade 5 flows from the vicinity of the air intake part 21 gradually toward the distal part 22 in association with the rotation of the fan blades 5, while flowing downward or upward as mentioned above (see a broken-line-arrow F of FIG. 2). Since the distal part 22 of each fan blade 5 has its opposite end surfaces 36B and 37B surrounded by the casing 2 and the cover 3, respectively, the vertically arranged front surface 33B allows the air F reaching the distal part 22 to be further strongly impelled in the perimetric direction without escaping from the intake holes 8 and 9. Thus, the air F that reached the distal end of the fan blade 5 is discharged at high pressure toward the outside through the discharge hole 10 arranged perpendicularly to the direction defined by the intake holes 8 and 9.

The present embodiment is further advantageous in that the air intake part 21 of the fan blade 5 is arranged at the fitting angle of "90 deg minus theta 1" which enables the efficient impelling of the air F by the front surface 33A, while the distal part 22 of the fan blade 5 is arranged at the fitting angle of "90 deg minus theta 2" which enables the air F to be sent out at an angle for the discharge hole 10, thereby enabling air intake efficiency to be improved further in cooperation with the configuration of the front surface 33A while enabling the air F to be sent out smoothly.

Figure 5:
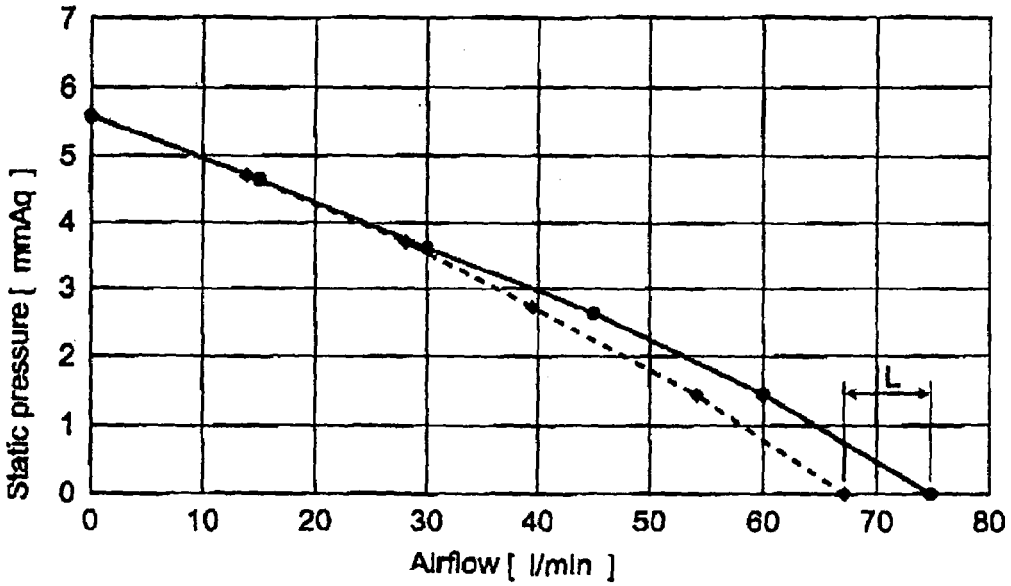
Figure 6:
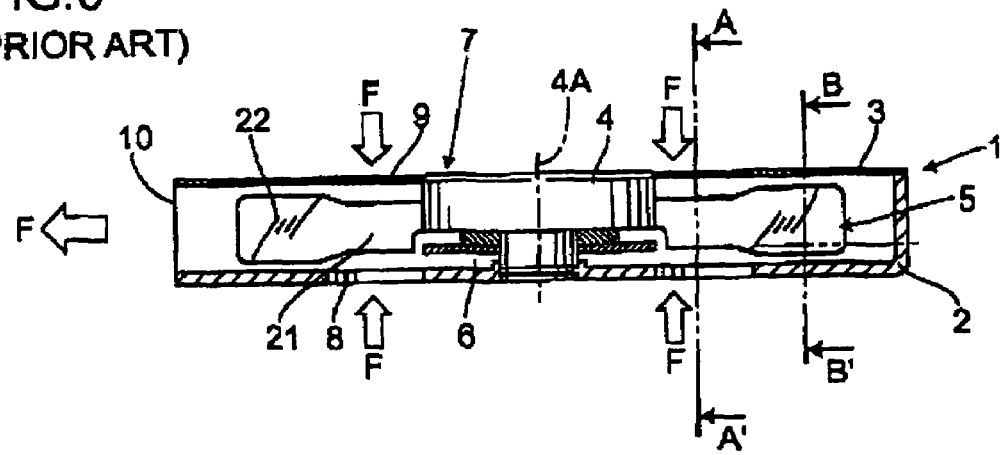
FIG.6 (PRIOR ART)
FIG. 6 is a graph showing a relationship between fan airflow and fan static pressure under the same noise level.
Figure 7:
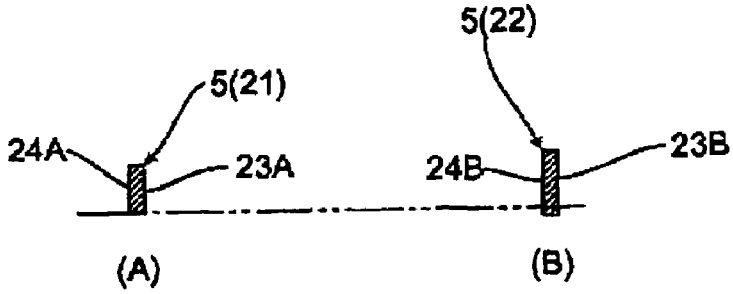
FIG.7 (PRIOR ART)
FIG. 7 (A) is a section of the conventional fan motor of FIG. 6 taken along A–A' line thereof, while FIG. 6 (B) is a section thereof taken along B–B' line thereof.
Figure 8:
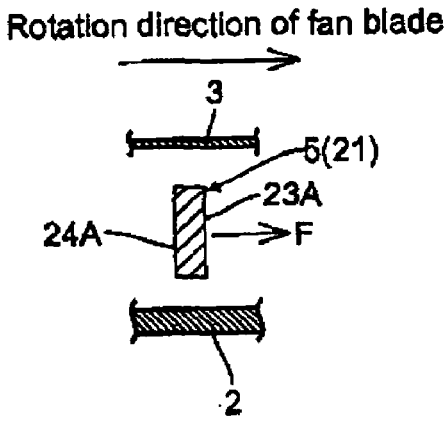
FIG.8 (PRIOR ART)
FIG. 8 is a section of a principal part of a fan blade, illustrating airflow in the conventional fan motor.

FIG. 5 shows an airflow-static pressure characteristic in the present embodiment and the conventional one, indicating a result of comparison between them under a same noise condition. In the drawing, a full line indicates an airflow-static pressure characteristic according to the present embodiment, while a broken line that of the conventional one. As is apparent from that, the airflow increases in the fan motor of the present embodiment than in the conventional one under the same level of static pressure (see symbol L).

As above described, the fan motor 1 according to the present embodiment comprises a plurality of the fan blades 5 extending radially of the perimeter of the rotor 4, the fan blade 5 having the front surface 33A at the air intake part 21 and the front surface 33B at the distal part 22, the surfaces 33A and 33B having different curvatures.

Thus, due to the different curvatures of the front surface 33A at the air intake part 21 and the front surface 33B at the distal part 22, the air F can be impelled toward the perimetric direction of the fan blades 5 while promoting the intake of the air toward the fan blades 5. Accordingly, the amount of air to be inhaled toward the fan blades 5 is increased, thus obtaining desirable airflow characteristics.

Further, as the fitting angle of the fan blade 5 to the rotor 4 is different at the air intake part 21 (i.e., 90 dog minus theta 1) than at the distal part 22 side (i.e., 90 deg minus theta 2), thus enabling the air F impelled out by the front surface 33B of the fan blade 5 to be directed to a desirable angle (toward the discharge hole 10, for example).

Specifically, the fan motor 1 of the present embodiment comprises the front surfaces 33A, 33B that define a different curvature at its inner perimetric side (the air intake part 21) and its perimetric side (the distal part 22), respectively. These front surfaces 33A, 33B of different curvatures enable the air F to be impelled toward the perimetric direction of the fan blades 5 at the same time as the promotion of the introduction of the air particularly toward the intake parts 21 of the fan blades 5. Accordingly, the amount of air to be inhaled toward the fan blades 5 is increased, thus obtain desirable airflow characteristics.

More specifically, as the shapes of the fan blades 5 differ alternately, such specific shapes of the fan blades are particularly advantageous to a double-sided-air intake structure that allows the air F to be inhaled toward the air intake part 21 of the fan blade 5 from both sides thereof in the rotation axis 4A. In other words, the fan blades 5 of two different shapes promoting the intake of air from the one and the other sides of the fan blades with respect to the rotational axis 4A are provided to alternately extend from the perimeter of the rotor 4, whereby the air F can be introduced evenly from both sides of the fan blades with respect to the rotational axis 4A.

As the fan motor of the present embodiment employs the structure that allows the air to be inhaled from the opposite end surfaces 36A and 37A of each fan blade 5, the amount of air to be inhaled is increased due to the air F being inhaled from the opposite end surfaces 36A, 37A, thus enabling the increasing of potential airflow in the fan motor 1.

Moreover, the fan blade 5 of the present embodiment comprises the curved front surface 33A provided in the air intake part 21 adjacent to the rotor 4, the intake of the air by the fan blade 5 toward the rotor 4 is more effectively promoted by this curved surface 33A and at the same time the air F drawn in toward the rotor 4 is smoothly sent out toward the distal part 22 of the fan blade 5 by the centrifugal force thereof, thus obtaining ideal airflow characteristic.

In a more preferable form of the invention, the fan blade 5 of the invention may comprise two or more curvatures combined at the air intake part 21 adjacent to the rotor 4. In that case, due to the front surface 33A being formed so as to combine two or more curvatures in the part of the fan blade 5 adjacent to the rotor 4, it is possible to realize extremely effective intake of air toward the rotor 4 in the fan blade 5. Further, the air inhaled toward the rotor 4 is smoothly sent out toward the distal part 22 of the fan blade 5 by the rotation centrifugal force from the fan blade 5, thereby realizing more ideal airflow characteristics.

Still also, it is to be noted that the fan blades 5 that are not formed separately from the rotor 4 but integrally therewith make it possible to manufacture the rotor 4 integral with the fan blades 5 of complex shapes at a time.

In addition to the foregoing, with the thickness "t" of each fan blade 5 being 1.5 min or below, an interruption of air-inhalation toward the fan blade 5 can be prevented as much as it can be, while realizing reduction in weight of the fan blade 5, thus obtaining desirable airflow characteristic.

The present invention should not be limited to the foregoing embodiment, but may be modified within the scope of the invention. For example, whilst the fan blade 5 is attached at angles +theta 1 and +theta 2 clockwise from the axis X0, it may be attached at angles −theta 1 and −theta 2 clockwise therefrom (or at angles +theta 1 and +theta 2 anticlockwise therefrom). In addition, the fan blade 5 may be formed so as to have an acute angle at the rotor 4 side thereof.

What is claimed:

1. A fan motor which comprises:

a cylindrical rotor;

one or more fan blades extending from a perimeter of said cylindrical rotor in a radial direction of the rotor, each fan blade having a proximal side adjacent to the rotor and a distal side, wherein said fan blade has a first surface on the proximal side and a second surface on the distal side, said first and second surfaces having different curvatures, wherein the curvature of said first surface allows the air drawn in from a rotational axis of said rotor to be impelled such that the air is raked up gradually toward the distal side in association with the rotation of said fan blades, wherein the curvature of said second surface allows the air flowing from the proximal side to be further strongly impelled in a perimetric direction, and wherein said fan blade has opposite end surfaces from which air is drawn in.

2. The fan motor according to claim 1, wherein said fan blade has a curved surface on the proximal side.

3. The fan motor according to claim 1, wherein said fan blade has a shape with a plurality of curvatures combined on the proximal side.

4. The fan motor according to claim 1, wherein said fan blades are formed integrally with said rotor.

5. The fan motor according to claim 1, wherein said fan blade is formed to a thickness of 1.5 mm or below.

6. The fan motor according to claim 1, wherein said fan blade has a different fitting angle to the rotor on the proximal side than on the distal side.

7. The fan motor according to claim 6, wherein said fan blade has a curved surface on the proximal side.

8. The fan motor according to claim 6, wherein said fan blade has a shape with a plurality of curvatures combined on the proximal side.

9. The fan motor according to claim 6, wherein said fin blades are formed integrally with said rotor.

10. The fan motor according to claim 6, wherein said fan blade is formed to a thickness of 1.5 mm or below.

11. A fan motor which comprises:

a cylindrical rotor;

one or more fan blades extending in a radial direction of the rotor, each fan blade having a proximal side and a distal side outward of the proximal side, said proximal side and said distal side defining an inner perimetric side and an outer perimetric side with respect to an air intake part, respectively when the rotor is rotated, wherein said fan blade has a first surface on the inner perimetric side and a second surface on the outer perimetric side, said first and second surfaces having different curvatures, wherein the curvature of said first surface allows the air drawn in from a rotational axis of said rotor to be impelled such that the air is raked up gradually toward the outer perimetric side in association with the rotation of said fan blades, wherein the curvature of said second surface allows the air flowing from the inner perimetric side to be further strongly impelled toward the perimetric side, and wherein said fan blade has opposite end surfaces from which air is drawn in.

12. The fan motor according to claim 11, wherein said fan blade has a curved surface on the proximal side.

13. The fan motor according to claim 11, wherein said fan blade has a shape with a plurality of curvatures combined on the proximal side.

14. The fan motor according to claim 11, wherein said fan blades are formed integrally with said rotor.

15. The fan motor according to claim 11, wherein said fan blade is formed to a thickness of 1.5 mm or below.

16. A fan motor, comprising a cylindrical rotor;

one or more fan blades extending in a radial direction of the rotor, each fan blade having a proximal side and a distal side outward of the proximal side, said proximal side and distal side defining an inner perimetric side and an outer perimetric side with respect to an air intake part, respectively when the rotor is rotated, wherein said fan blade has a first surface on the inner perimetric side and a second surface on the outer perimetric side, said first and second surfaces having different curvatures, wherein the curvature of said first surface allows the air drawn in from a rotational axis of said rotor to be impelled such that the air is raked up gradually toward the outer perimetric side in association with the rotation of said fan blades, wherein the curvature of said second surface allows the air flowing from the inner perimetric side to be further strongly impelled toward the perimetric side, and wherein shapes of said fan blades differ alternately.

17. The fan motor according to claim 16, wherein said fan blade has opposite end surfaces from which air is drawn in.

18. The fan motor according to claim 16, wherein said fan blade has a curved surface on the proximal side.

19. The fan motor according to claim 16, wherein said fan blade has a shape with a plurality of curvatures combined on the proximal side.

20. The fan motor according to claim 16, wherein said fan blades are formed integrally with said rotor.

21. The fan motor according to claim 16, wherein said fan blade is formed to a thickness of 1.5 mm or below.

* * * * *